US006173755B1

(12) United States Patent
Li et al.

(10) Patent No.: US 6,173,755 B1
(45) Date of Patent: Jan. 16, 2001

(54) NOZZLE FOR CONTINUOUS SLAB CASTING

(75) Inventors: Nai-Yi Li, Murrysville; Que-Tsang Fang, Export; Donald J. Clements, Apollo, all of PA (US)

(73) Assignee: Aluminum Company of America, Pittsburgh, PA (US)

( * ) Notice: Under 35 U.S.C. 154(b), the term of this patent shall be extended for 0 days.

(21) Appl. No.: 08/652,871

(22) Filed: May 23, 1996

(51) Int. Cl.[7] ..... B22D 11/06; B22D 11/10; B22D 41/50

(52) U.S. Cl. ..... 164/429; 164/432; 164/437; 222/591

(58) Field of Search ..... 164/490, 431, 164/432, 434, 439, 440, 463, 423, 429, 437, 443; 222/591, 590

(56) References Cited

U.S. PATENT DOCUMENTS

| | | | | |
|---|---|---|---|---|
| 2,348,178 | * | 5/1944 | Merle | 164/437 |
| 3,774,670 | | 11/1973 | Gyöngyös | 164/279 |
| 4,290,477 | | 9/1981 | Huber et al. | 164/430 |
| 4,485,835 | | 12/1984 | Huber et al. | 164/430 |
| 4,602,668 | | 7/1986 | Bolliger | 164/452 |
| 4,619,309 | | 10/1986 | Huber et al. | 164/430 |
| 4,649,984 | * | 3/1987 | Bedell et al. | 164/437 |
| 4,721,152 | | 1/1988 | Reichelt et al. | 164/429 |
| 4,785,873 | | 11/1988 | Lauener | 164/481 |
| 4,791,979 | * | 12/1988 | Liebermann | 164/463 |
| 4,798,315 | | 1/1989 | Lauener | 222/591 |
| 4,928,748 | * | 5/1990 | Guthrie et al. | 164/429 |
| 5,660,757 | * | 8/1997 | Smith | 164/437 |

FOREIGN PATENT DOCUMENTS

| | | | | |
|---|---|---|---|---|
| 60-21169 | * | 2/1985 | (JP) | 164/437 |

* cited by examiner

*Primary Examiner*—Patrick Ryan
*Assistant Examiner*—I.-H. Lin
(74) *Attorney, Agent, or Firm*—Alan G. Towner; Gary P. Topolosky

(57) ABSTRACT

An improved casting nozzle for continuous slab casting machines is provided. The nozzle includes a sloped surface which reduces molten metal turbulence during the casting process. The nozzle also includes a resilient, thermal insulation layer which prevents undesired backflow and premature solidification of the molten metal near the nozzle tip. The nozzle may also include a friction reducing layer which prevents excessive wear or fracture of the nozzle as it contacts the casting mold. The casting nozzle is suitable for use with both horizontal and vertical continuous casting machines, and may be used with various types of casting molds including continuous belt or caterpillar molds, and stationary molds. The improved nozzle may be used to cast various metals such as aluminum and aluminum alloys.

12 Claims, 11 Drawing Sheets

NOZZLE FOR CONTINUOUS SLAB CASTING

BACKGROUND OF THE INVENTION

The present invention relates to continuous slab casting of metals, and more particularly to a molten metal delivery nozzle for continuous slab casting which reduces turbulence and premature freezing of the molten metal, thereby improving the surface quality of the resultant casting.

Continuous casting techniques have been used to form slabs or strips of various metals such as aluminum, copper, zinc and steel. Several types of continuous casting machines are known. For example, one type of casting machine comprises an opposing pair of moving continuous belts which form a mold into which molten metal is introduced. U.S. Pat. Nos. 4,602,668, 4,785,873 and 4,798,315 disclose such continuous belt casting machines.

Continuous slab casting machines have also incorporated opposing caterpillar-type molds in place of continuous belts, as shown in U.S. Pat. Nos. 3,774,670, 4,290,477, 4,485,835 and 4,619,309.

Prior art slab casting machines have also incorporated a single flat surface onto which the molten metal is cast. U.S. Pat. No. 4,721,152 discloses one such single-belt continuous casting machine.

A major disadvantage of prior art continuous slab or strip casting machines is the production of castings having poor surface quality due to such factors as molten metal turbulence and premature solidification near the nozzle tip. These problems are thought to result from meniscus instability of the molten metal at the nozzle discharge area. Attempts have been made to reduce meniscus instability by methods such as shrouding the molten metal with inert gas as it exits the nozzle. However, the control of meniscus instability by such methods is difficult and has not resulted in a consistent production of castings having optimum surface quality.

The present invention has been developed in view of the foregoing and to overcome other deficiencies of the prior art.

SUMMARY OF THE INVENTION

The present invention provides an improved molten delivery nozzle for continuous slab or strip casting which reduces turbulence, backflow and premature freezing of the molten metal, thereby producing cast slabs having highly superior surface quality. The improved nozzle promotes meniscus stability during the casting operation which reduces porosity and improves the surface quality of the cast products.

An object of the present invention is to provide an improved molten delivery nozzle for use in slab or strip casters.

Another object of the present invention is to provide an apparatus for casting a metal slab or strip including a casting mold and a molten delivery nozzle slidingly engaged with the casting mold for delivering molten metal to the mold. The nozzle includes at least one resilient, thermal insulation layer which provides a seal between the casting mold and nozzle, and prevents premature solidification of molten metal near the nozzle tip. The casting mold may comprise a continuous belt or caterpillar mold, or may comprise a stationary mold.

Another object of the present invention is to provide a molten metal delivery nozzle having a sloped configuration which reduces molten metal turbulence during the casting operation.

Another object of the present invention is to provide a method of casting a metal slab or strip including the use of a casting mold and a molten metal delivery nozzle in sliding engagement with the mold. Molten metal is delivered through the nozzle into the mold where it solidifies to form a slab or strip. During the casting process, the meniscus of the molten metal is controlled in order to improve surface quality of the resultant slab. The nozzle is configured such that it reduces turbulence, backflow and premature solidification of the molten metal at the nozzle tip. The method may include the use of horizontal or vertical continuous casting machines.

DETAILED DESCRIPTION OF THE PREFERRED EMBODIMENTS

Figure 1:
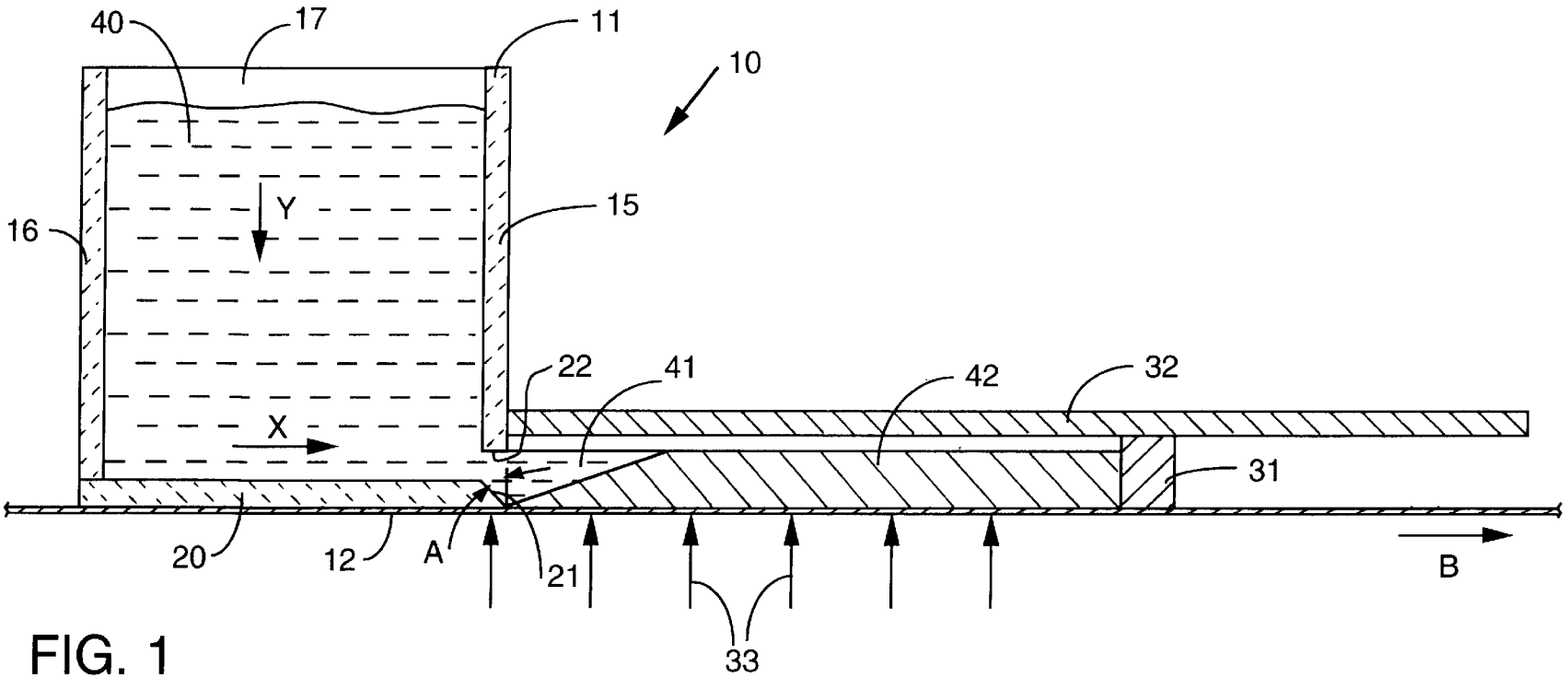
FIG. 1 is a partially schematic cross-sectional side view showing a continuous casting apparatus in accordance with an embodiment of the present invention.
Figure 2:
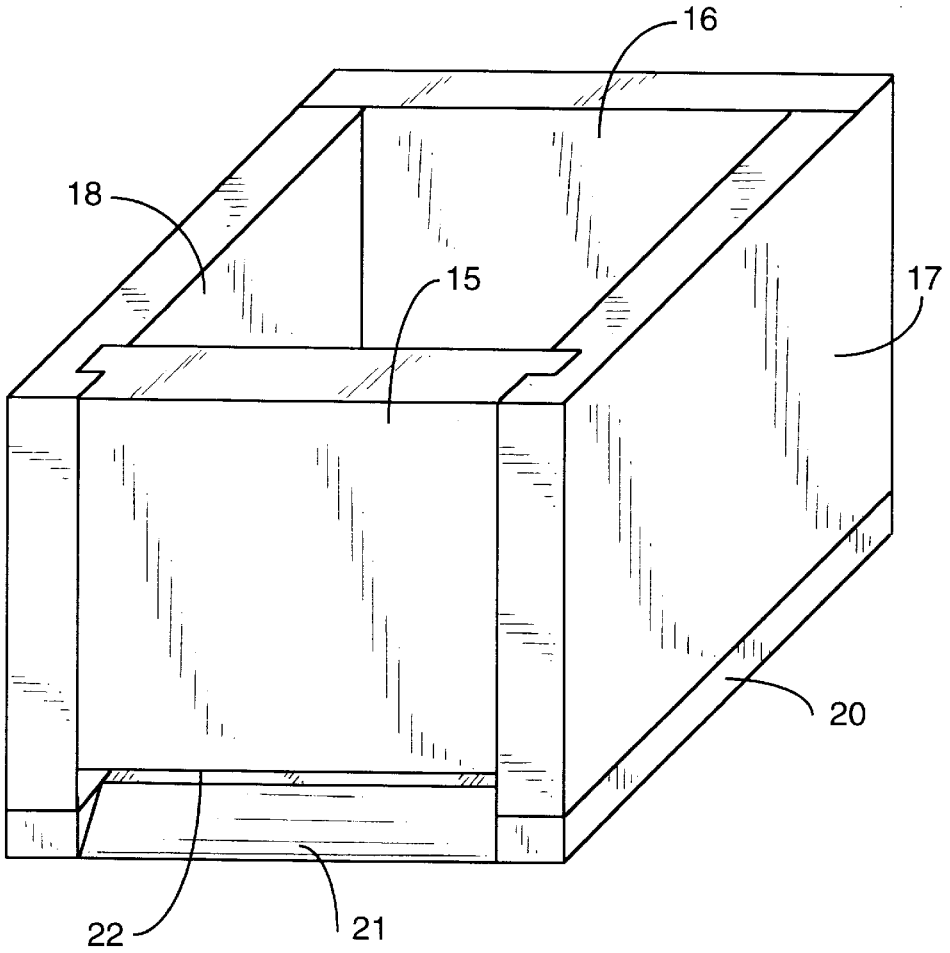
FIG. 2 is a perspective view showing a molten metal delivery container including a casting nozzle in accordance with an embodiment of the present invention.

Referring to the drawings, wherein like reference numerals represent like elements throughout the several figures, FIG. 1 is a partially schematic cross-sectional side view showing a continuous caster 10 in accordance with the present invention. The caster includes a molten metal feed container 11 disposed on a casting belt 12. The container 11 comprises a front wall 15, a back wall 16 and a side wall 17. Although not shown in the cross-sectional view of FIG. 1, the container 11 comprises another side wall 18, as shown in FIG. 2. The container 11 also comprises a bottom nozzle 20 which, in the embodiment shown in FIG. 1, rests on the casting belt 12. The right portion of the bottom nozzle 20 shown in FIG. 1 comprises a sloped surface 21 disposed at an angle A measured from the vertical direction. The lower portion of the front wall 15 comprises an opening 22. The sloped surface 21 and side wall opening 22 define a slit-like nozzle opening for the container 11. As more fully described below, the angle A of the sloped surface 21 is selected in order to reduce turbulence and improve meniscus stability during the casting operation. While the sloped surface shown in FIG. 1 is substantially flat or planar, the sloped surface can alternatively be curved. For example, the sloped surface may be have a concave or convex configuration.

During casting, the casting belt 12 moves in the direction B shown in FIG. 1. Alternatively, during the casting operation, the belt 12 may be held stationary while the container 11 is moved toward the left in FIG. 1. The slab caster may include an end dam 31 to provide containment for the molten metal during the casting operation. In addition, the caster may include a cover made of graphite 32 which serves as an insulator to prevent heat transfer towards the free surface. During the casting operation, cooling fluid 33 may be directed toward the casting belt 12 in the area of the nozzle tip as shown in FIG. 1 in order to extract heat from the casting and aid in the solidification of the slab.

Molten metal 40 is introduced into the container 11 where it is preferably maintained at a level sufficient to supply a sufficient pressure head during casting. While it is preferred to carry out the casting operation at atmospheric pressure, it is also possible to supply the molten metal through a pressurized container. After it is introduced into the container 11, the molten metal 40 flows generally in the vertical direction Y toward the bottom of the container, where it is then directed in the horizontal direction X toward the sloped surface 21 of the nozzle 20. As it exits the container 11 through the sloped nozzle opening 21, the molten metal contacts the casting belt 12 which serves as a mold for the cast metal. With the aid of the cooling fluid 33, the metal solidifies from the molten state 41 to the solid state 42 to form a slab.

The sloped surface 21 minimizes the cascade height in the area of the nozzle tip, and promotes laminar flow of the molten metal as it exits the container 11 into the casting mold. The cascade height, which is defined by the distance from the edge of the nozzle tip to the mold, is preferably less than 0.1 inch and more preferably less than 0.0625 inch. The angle A of the sloped surface 21 may range from 5 to 85 degrees, with angles of 15 to 80 degrees being preferred. The angle A is selected such that turbulence of the molten metal is reduced in the nozzle tip area.

The front, back and side walls 15, 16, 17 and 18 of the container 11 are made from any suitable material, preferably a refractory material capable of withstanding the elevated temperature and reactive nature of the molten metal to be cast. Calcium silicate board sold under the name PYROTEK B-3 is suitable. The bottom nozzle 20 of the container 11 is likewise made of a material capable of withstanding the elevated temperature and corrosive nature of the particular molten metal. Furthermore, the bottom nozzle 20, which is in sliding engagement with the belt 12 during the casting operation, comprises means for sealing the container 11 against the casting belt 12. By providing a seal between the container 11 and the casting belt 12, the bottom nozzle 20 prevents undesired backflow of molten metal, which improves the surface quality of the resultant cast product. In addition, the bottom nozzle 20 comprises a material having low thermal transfer characteristics, which acts as an insulator to reduce or eliminate premature solidification of the molten metal during casting. Thus, in addition to containing the molten metal, the bottom nozzle 20 also functions as a molten metal seal and as a thermal barrier. These features, in combination with the sloped surface 21 of the nozzle, provide a molten metal delivery nozzle which reduces turbulence, backflow and premature solidification of the molten metal near the nozzle tip, which improves slab surface quality. The nozzle of the present invention controls the meniscus of the molten metal at the nozzle discharge area, thereby improving the surface quality of the cast slab. The meniscus is controlled to provide the desired angle of contact between the molten metal and the mold at the tip area.

In a preferred embodiment, the bottom nozzle 20 may also be provided with a friction reducing surface in order to decrease the friction generated at the interface of the container 11 and the casting belt 12, and to protect the bottom of the container from excessive wear or fracture.

FIG. 2 is a perspective view of a molten metal feed container 11 in accordance with an embodiment of the present invention. The container 11 comprises front wall 15, back wall 16 and side walls 17 and 18. When fully assembled, the front wall slides into retaining grooves 19 disposed in the side walls 17 and 18. As shown more clearly in FIGS. 3 and 4, the front wall 15 includes stepped edges which fit within the retaining grooves 19 of the side walls. The retaining grooves 19 terminate a short distance from the bottom nozzle 20 of the container 11. When the front wall is installed in the grooves, a small slit-like opening is provided along the lower front edge of the container adjacent to the sloped surface 21. In accordance with the present invention, the height of the opening may be adjusted to control the rate of molten metal flow through the nozzle. The height of the opening is preferably set at a level which facilitates laminar flow of the molten metal as it exits the container through the nozzle.

Figure 3:
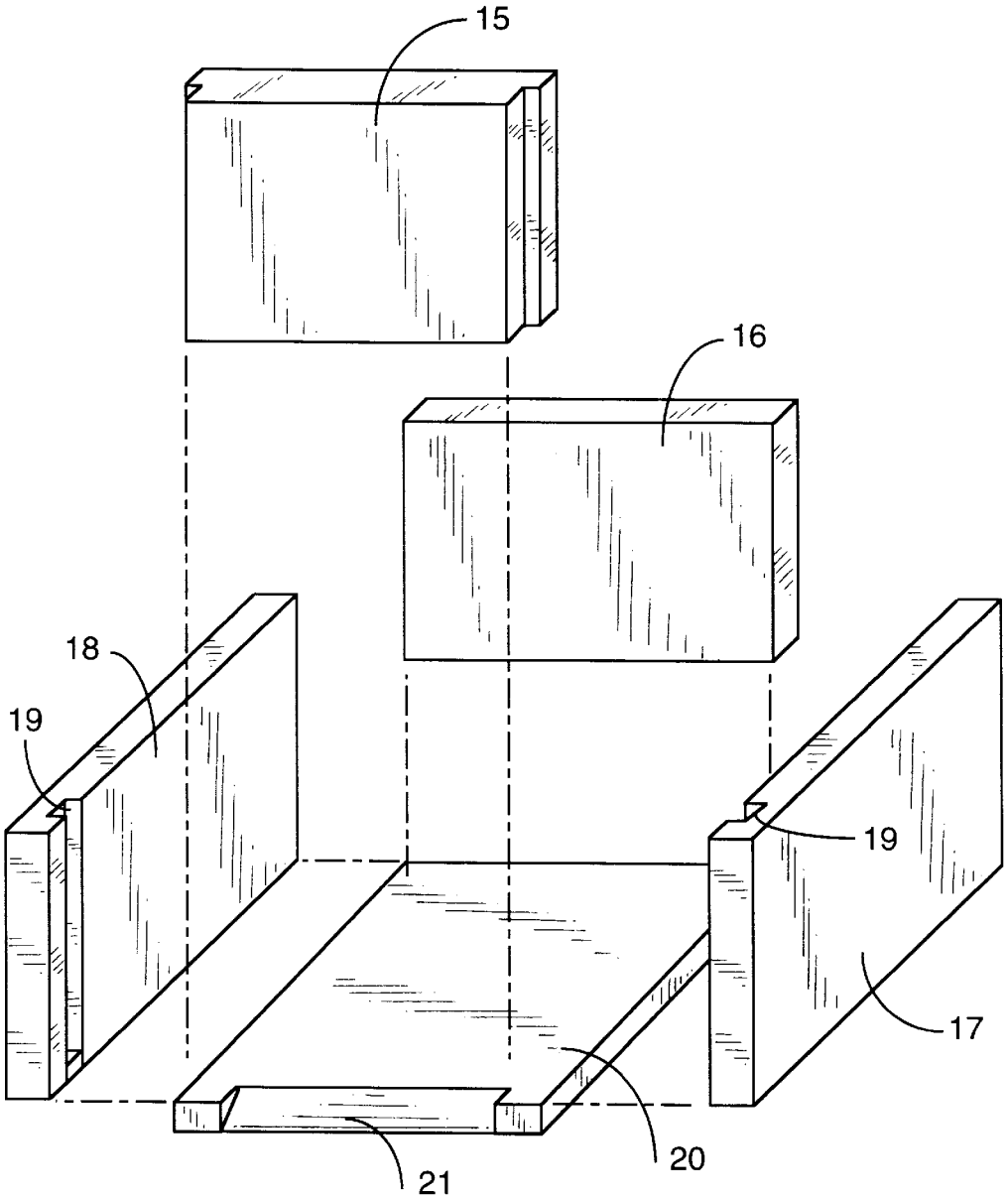
FIG. 3 is an exploded view of the casting container shown in FIG. 2.
Figure 4:
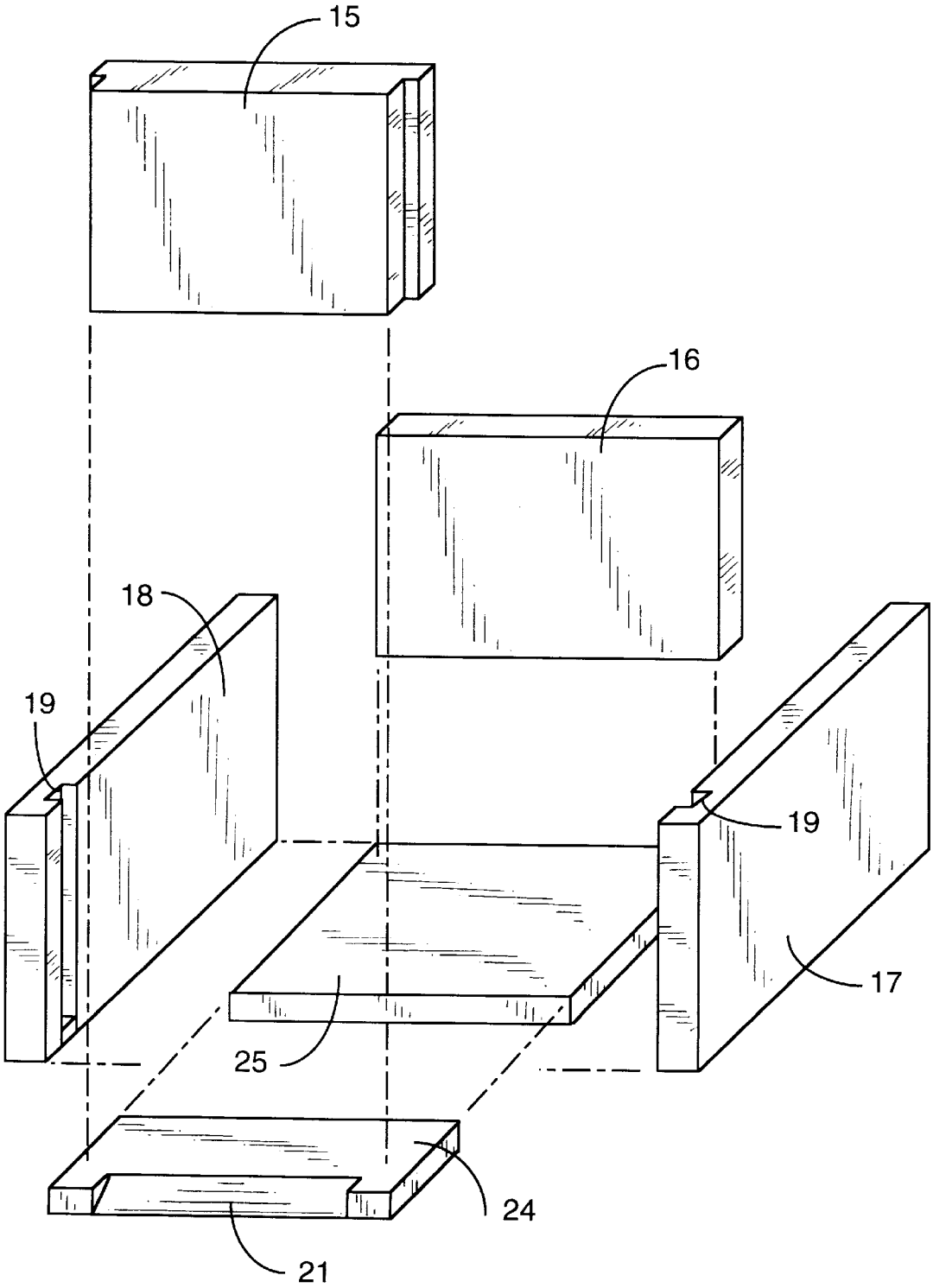
FIG. 4 is an exploded view of a molten metal delivery container including a casting nozzle in accordance with a preferred embodiment of the present invention.

FIGS. 3 and 4 are exploded views of alternate embodiments of the present invention. In each of these embodiments, the container includes front and back walls 15 and 16, as well as side walls 17 and 18. The side walls 17 and 18 include retaining grooves 19 for the front wall. In the embodiment of FIG. 3, the bottom nozzle 20 and the sloped surface 21 are provided as a unitary piece. In contrast, the bottom portion shown in FIG. 4 comprises a nozzle tip portion 24 including the sloped surface 21 and a separate body portion 25. The use of separate tip and body portions as shown in FIG. 4 has the advantage that it can be replaced easily if the tip becomes worn, or if a different tip slope is desired.

Figure 5:
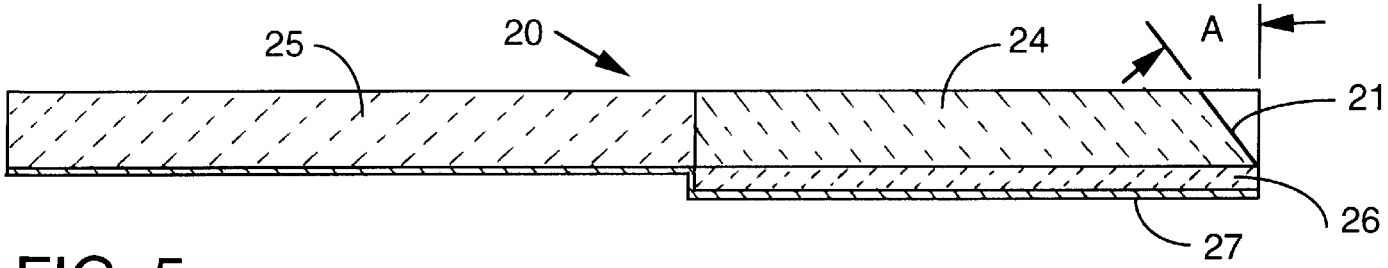
FIG. 5 is a cross-sectional side view showing a portion of a casting nozzle in accordance with a preferred embodiment of the present invention.
Figure 6:
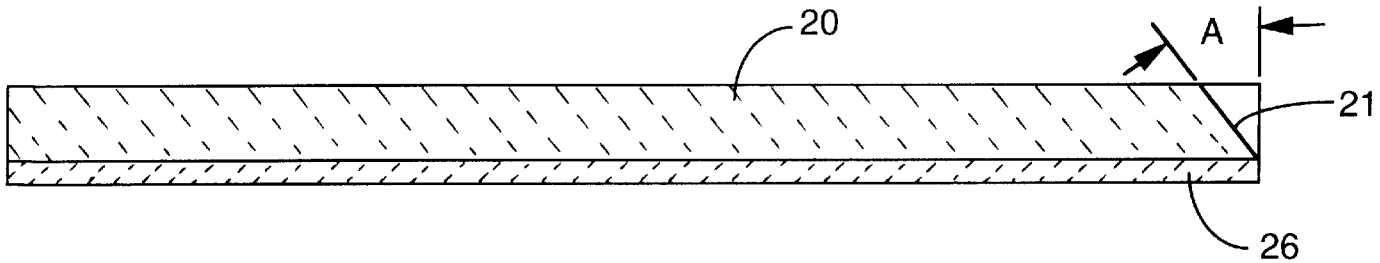
FIG. 6 is a cross-sectional side view showing a portion of a casting nozzle in accordance with an alternative embodiment of the present invention.
Figure 7:
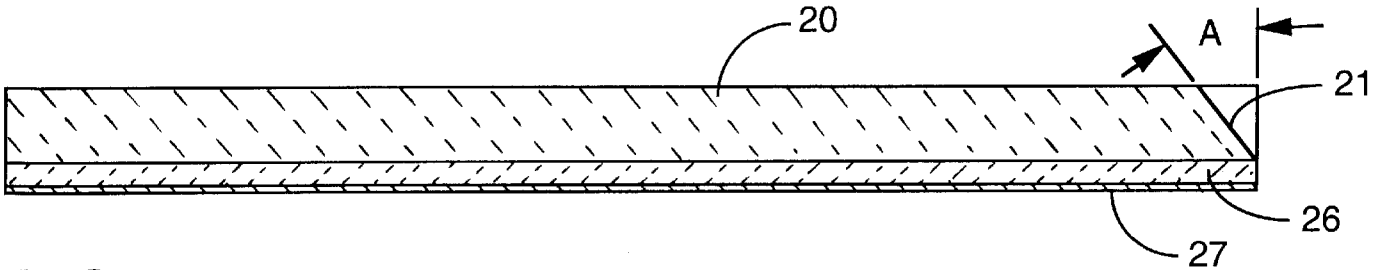
FIG. 7 is a cross-sectional side view showing a portion of a casting nozzle in accordance with another embodiment of the present invention.

FIGS. 5–7 show cross-sectional side views of bottom nozzles 20 in accordance with various embodiments of the present invention. In FIG. 5, the bottom nozzle 20 comprises a tip portion 24 and a body portion 25 similar to that shown in FIG. 4 made of refractory material such as PYROTEK B-3. In addition, the bottom surface of the tip 24 shown in FIG. 5 is provided with a layer of resilient insulating material 26 which possesses elastic as well as thermal insulating properties. A particularly preferred material for the layer 26 is non-respirable fiber paper comprising fibrous glass and a latex binder which is sold under the name Q-BLOC. The bottom nozzle 20 shown in FIG. 5 also includes a friction reducing layer 27 which covers both the resilient insulating layer 26 of the tip 24 and the bottom surface of the body portion 25. During the casting operation, the friction reducing layer 27 contacts the casting belt to reduce friction between the container 11 and the casting belt 12, and to prevent excessive wear of the container. Graphite is a preferred material for the friction reducing layer 27. In particular, graphite in the form of flexible foil having a thickness of 0.01 inch sold under the name GRAFOIL is a preferred material for the friction reducing layer 27.

As shown in FIG. 5, the tip 24 includes a sloped surface 21 disposed at an angle A as described above. The various components shown in FIG. 5 may be assembled in any suitable manner, with the use of high temperature-resistant adhesives being preferred. For example, core paste sold under the name ZIP STICK may be used as an adhesive to secure the components together. The dimensions of the components shown in FIG. 5 may be varied to achieve the desired results. For example, the thickness of the back portion 25 and tip portion 24 may preferably range from 0.2 to 2 inch, and more preferably from 0.25 to 1.0 inch. Where PYROTEK B-3 is used as the back and tip portions, a thickness of 0.5 inch is suitable. The thickness of the resilient insulating layer 26 is typically less than about 0.3 inch, preferably ranging from about 0.05 to 0.25 inch, and more preferably from about 0.1 to 0.2 inch. Where Q-BLOC is used as the resilient insulating layer 26, a thickness of 0.125 inch is suitable. The friction reducing layer 27 is preferably provided as a thin layer ranging from about 0.001 to 0.1 inch, and more preferably from about 0.005 to 0.02 inch. Where GRAFOIL is used as the friction reducing layer 27, a thickness of 0.01 inch is suitable.

FIG. 6 illustrates a bottom nozzle 20 in accordance with another embodiment of the present invention. In this embodiment, the bottom nozzle 20 comprises a unitary piece of refractory material similar to the configuration shown in FIG. 3. A resilient insulating layer 26 is attached to the entire lower surface of the bottom nozzle 20. In this embodiment, the resilient insulating layer 26 comprises a material that is elastic and thermally insulating, as well as sufficiently durable to withstand contact with the casting belt during the casting operation. The resilient insulating layer 26 shown in FIG. 6 thus functions as a sealing layer to prevent molten metal backflow, a thermal insulator to prevent premature solidification of molten metal at the nozzle tip, and a durable, friction reducing layer.

In the embodiment shown in FIG. 7, the bottom nozzle 20 comprises a unitary piece of refractory material similar to the embodiments of FIGS. 3 and 6. However, the bottom nozzle 20 comprises a resilient insulating layer 26 disposed on the entire lower surface of the bottom nozzle 20, and a friction reducing layer 27 attached to the resilient layer 26. While the use of such a resilient insulating layer 26 provides a relatively flat surface for contacting the casting belt, the use of such a large layer of resilient insulating material may result in increased cost in comparison with the partial layer shown in FIG. 5.

Figure 8:
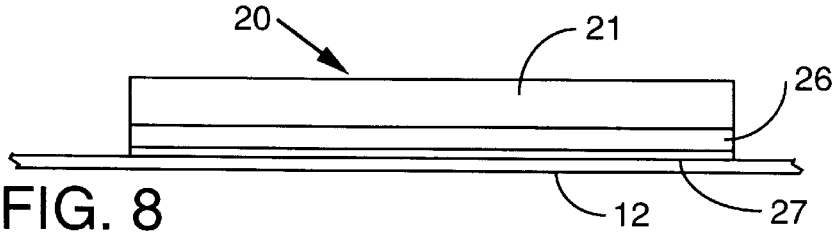
FIG. 8 is a front view showing a casting nozzle and casting belt in accordance with an embodiment of the present invention.

FIG. 8 is a front view of a nozzle 20 similar to that shown in FIGS. 5 and 7 disposed on a casting belt 12. The nozzle includes a sloped surface 21 as described previously, as well as a resilient insulating layer 26 and friction reducing layer 27. The area of contact between the casting belt 12 and friction reducing layer 27 is sealed across the entire width of the nozzle 20 through the elastic action of the resilient insulating layer 26.

Figure 9:
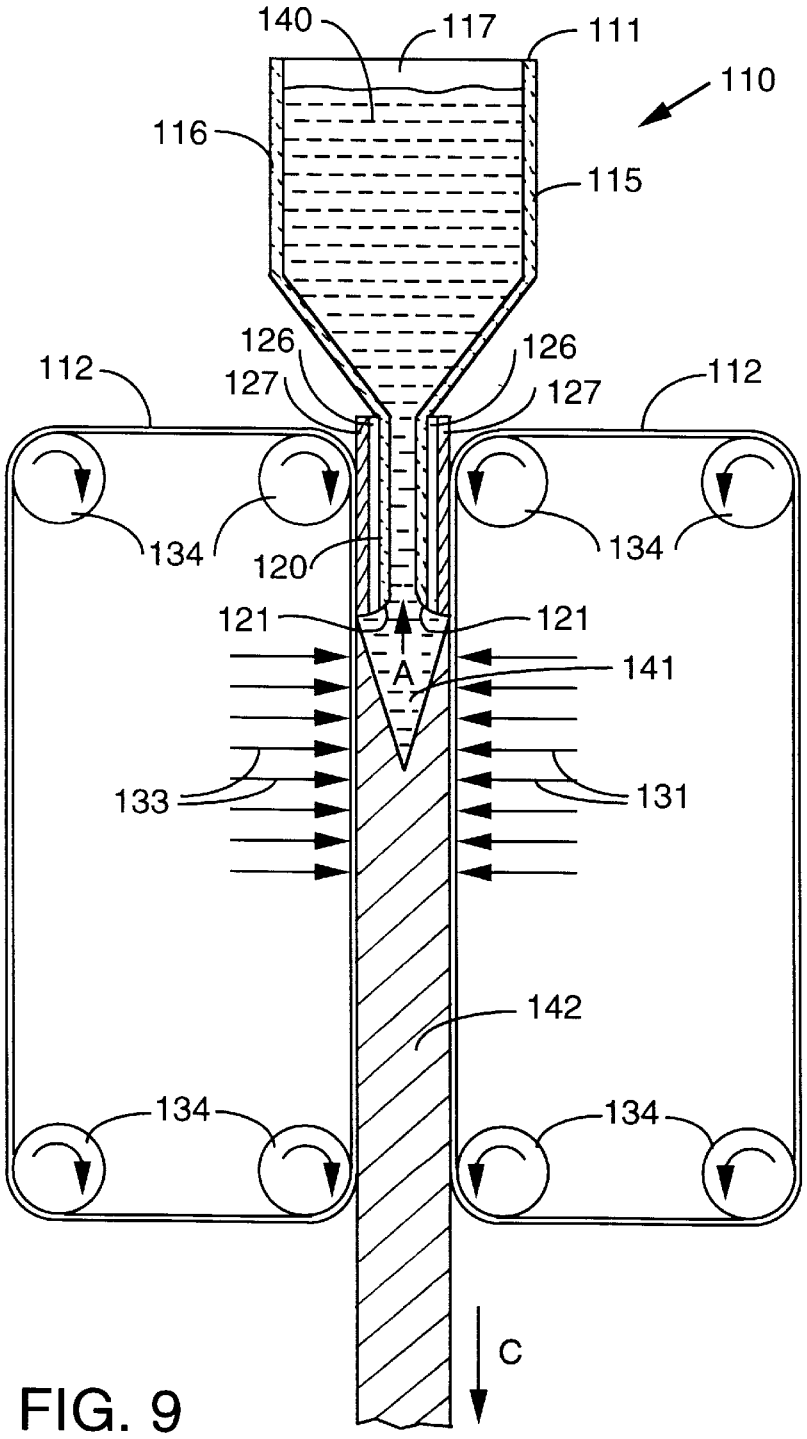
FIG. 9 is a partially schematic cross-sectional side view showing a continuous casting apparatus in accordance with another embodiment of the present invention.

FIG. 9 is a partially schematic cross-sectional side view of a vertical continuous casting apparatus in accordance with an alternative embodiment of the present invention. In this embodiment, the slab caster 110 comprises a molten metal tundish 111 having side walls 115, 116 and 117. The feed container 111 also comprises a fourth side wall which is not shown in the cross-sectional view of FIG. 9. The slab caster 110 includes a pair of opposing continuous casting belts 112 which form a continuous casting mold. The bottom portion of the container 111 tapers into a slot-shaped nozzle 120 which is inserted between the casting belts 112. The nozzle 120 comprises opposing sloped surfaces 121 which reduce turbulence during the casting operation, as more fully described below. The container 111 and the nozzle 120 are preferably made of refractory material such as PYROTEK B-3. The nozzle 120 comprises a pair of resilient insulating layers 126 disposed on the exterior surfaces of the refractory material. In addition, friction reducing layers 127 are attached to the resilient insulating layers 126. The layers 126 and 127 may be assembled together by any suitable means such as adhesives which are resistant to the high temperatures encountered during casting operations.

The continuous casting belts 112 are driven by a series of rolls 134. During casting, cooling fluid 133 is directed against the casting belts 112 in order to facilitate the solidification of the molten metal. Molten metal 140 introduced into the container 111 flows through the nozzle 120 into the casting mold formed by the continuous belts 112. Once introduced into the casting mold, the molten metal 141 solidifies to form a solid slab 142 which is removed from the casting mold in the direction C shown in FIG. 9.

The nozzle 120 shown in FIG. 9 comprises left and right portions, each of which has a sloped surface 121, a resilient insulating layer 126 and a friction reducing layer 127. Each of these portions may be configured in a manner similar to that shown in FIGS. 5–7.Thus, the sloped surface 121 is disposed at an angle A measured from the horizontal direction in FIG. 9, which corresponds with the angle A of the sloped surfaces 21 previously described: Each side of the nozzle 120 shown in FIG. 9 may comprise a tip portion having the resilient insulating layer disposed thereon, similar to the embodiment of FIG. 5. Furthermore, each side of the nozzle 120 may comprise a single layer of resilient insulating material which also serves as a wear-resistant friction reducing layer, similar to the embodiment shown in FIG. 6. Alternatively, each side of the nozzle 120 may be made from a single piece of refractory material having a resilient insulating layer and a friction reducing layer covering its entire surface in a manner similar to that shown in FIG. 7.

In the embodiment of FIG. 9, the resilient insulating layers 126 seal the nozzle 120 against the casting belts 112, thereby preventing unwanted backflow of molten metal. In addition, the layers 126 provide thermal insulation for the molten metal as it exits the nozzle 120, thereby preventing premature solidification near the nozzle tip that would otherwise occur due to the action of the cooling fluid 133. The friction reducing layers 127 serve to reduce the friction created between the nozzle 120 and the continuous belts 112, and to prevent excessive wear or fracture of the resilient insulating layers 126.

The vertical continuous casting apparatus shown in FIG. 9 has the advantage that the molten metal 141 entering the casting mold acts through the force of gravity to fill voids in the casting caused by solidification shrinking. The use of the resilient insulating layer 126 to tightly seal the nozzle 120 against the casting belts 112 advantageously prevents backflow and promotes meniscus stability of the molten metal during the casting operation. The sloped surfaces 121 promote laminar flow of the molten metal as it enters the mold cavity from the nozzle 120. By reducing the turbulence of the molten metal, the nozzle 120 controls meniscus instability during casting. Superior castings are thereby achieved having excellent surface quality.

While a single-belt horizontal slab caster is shown in FIG. 1 and a dual-belt vertical slab caster is shown in FIG. 9, the improved casting nozzle of the present invention is suitable for use in conjunction with other types of continuous casters. For example, the nozzle may be used with dual-belt horizontal slab casters and the like or with roll casters.

The following examples illustrate various aspects of the present invention and are not intended to limit the scope thereof.

EXAMPLE 1

Figure 10:
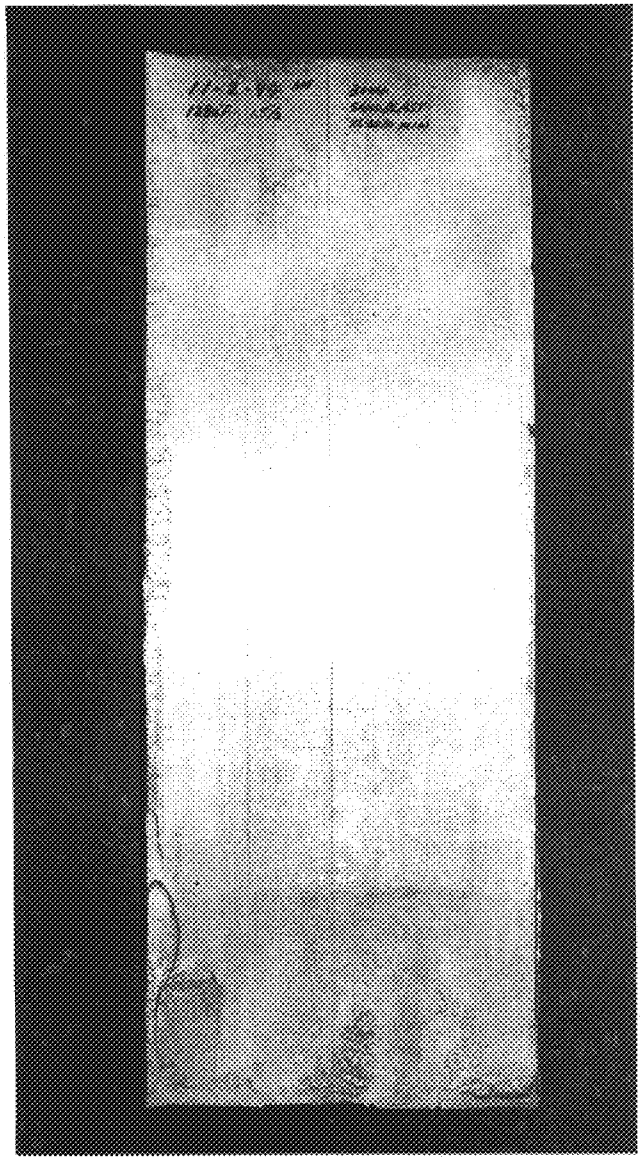
FIG. 10 is a photograph of the surface of a cast aluminum slab produced in accordance with an apparatus and method of the present invention.

A casting apparatus is provided comprising a stationary horizontal surface with two parallel side dams and an end dam defining a horizontal slab casting mold. The horizontal surface is made of steel sheet while the side and end dams are made of calcium silicate refractory material. The parallel side dams are placed 10 inches apart to define a 10 inch wide casting mold. A molten metal feed container comprising front, back and side walls is assembled from separate parts as shown in FIG. 4. The walls extend to a height of approximately 5.5 inches. The container comprises a bottom portion similar to that shown in FIGS. 1 and 4 having a width of approximately 5.625 inch, a length of 7.875 inch and a thickness of 0.5 inch. The bottom portion is assembled from two pieces of refractory material comprising tip and back portions similar to that shown in FIG. 5. The tip includes a sloped surface disposed at an angle A of 75 degrees measured from the vertical direction as shown in FIGS. 1 and 5. The bottom portion, as well as the front, back and side walls, are made of PYROTEK B-3 refractory material. A 0.125 inch thick sheet of Q-BLOC resilient insulating material is glued to the underside of the nozzle tip using ZIP STICK core paste. A 0.01 inch thick sheet of GRAFOIL friction reducing material is glued to the underside of the Q-BLOC, and is also glued to the exposed portion of the PYROTEK B-3 refractory material as shown in FIG. 5 using ZIP STICK core paste. The side, back and bottom sections of the feed container are glued together with ZIP STICK core paste, and the front wall of the container is slid into the retaining grooves in the side walls. The container is then placed on the horizontal surface of the casting mold between the parallel side dams and abutting the end dam. Molten aluminum having a composition of 1.2 Mn, 1.0 Mg, balance Al (Aluminum Association 3004) at a temperature of between 1260 and 1360° F. is poured into the feed container to a height of approximately 3.5 inches. The feed container is then slid at a constant rate of approximately 3.5 inches per second along the horizontal surface of the casting mold. During the casting operation, the lower surface of the casting mold is cooled by a series of water jets. The resulting aluminum slab is about 0.5 inch thick. Upon removal from the mold, the surface of the slab formed adjacent to the horizontal mold surface is examined and is found to be extremely smooth with minimal liquation and other defects, such as laps, ripples and coldshuts. The surface of the resultant slab is shown in the photograph of FIG. 10.

EXAMPLE 2

Example 1 is repeated for aluminum alloys having the following compositions: AA 5182 (4.5 Mg, 0.35 Mn, balance Al); and AA 5052 (2.5 Mg, 0.25 Cr, balance Al). In each case, the surface of the casting is similar to that shown in FIG. 10 with minimal liquation and other surface defects, such as laps, ripples and coldshuts.

EXAMPLE 3

Figure 11:
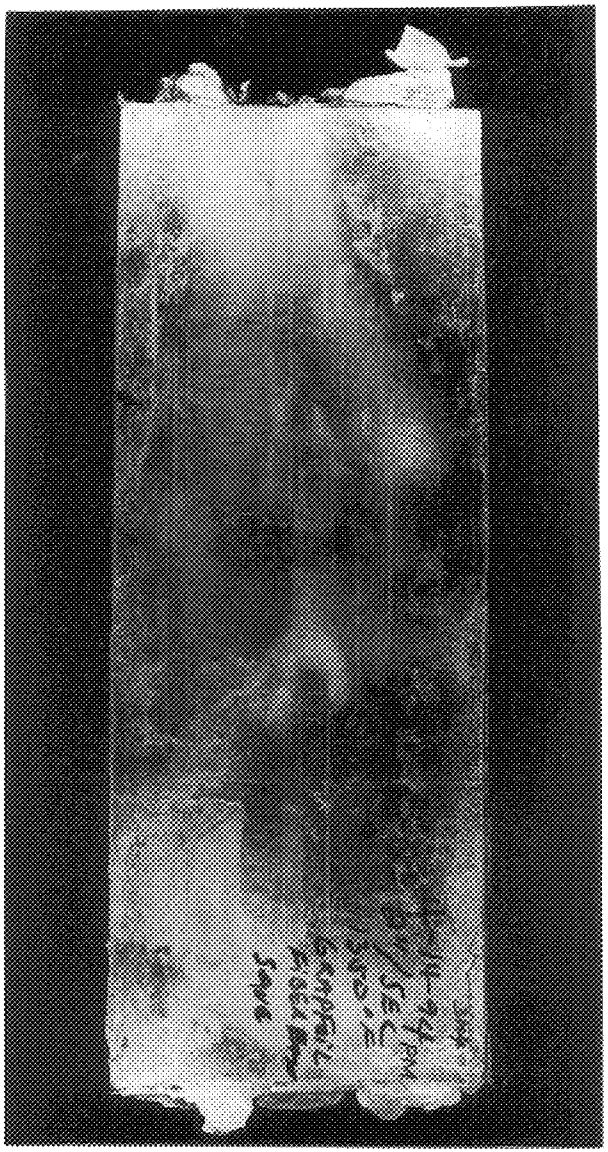
FIGS. 11–14 are comparative photographs of cast aluminum slabs showing the poor surface quality thereof.

Example 1 is repeated except the bottom nozzle portion of the feed container is not provided with a sloped surface but is rather provided with a vertical opening (angle A of 0 degrees). The resultant casting exhibits poor surface quality due to the large cascade height and the resulting local turbulence or circulation of the molten aluminum as it exits the feed container. The poor surface quality of the resultant slab is shown in the photograph of FIG. 11.

EXAMPLE 4

Figure 12:
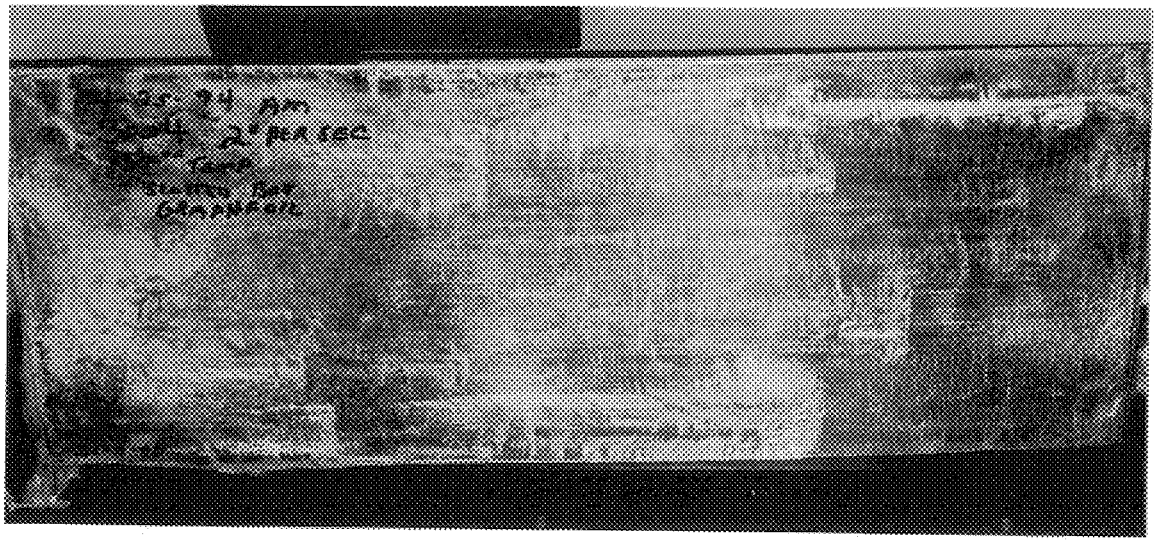

Example 1 is repeated except no layer of Q-BLOC resilient insulating material is disposed underneath the nozzle tip and no layer of GRAFOIL is used. The surface quality of the resultant slab is poor due to backflow and premature freezing of the molten metal near the nozzle tip. The poor surface quality of the resultant slab is shown in the photograph of FIG. 12.

EXAMPLE 5

Figure 13:
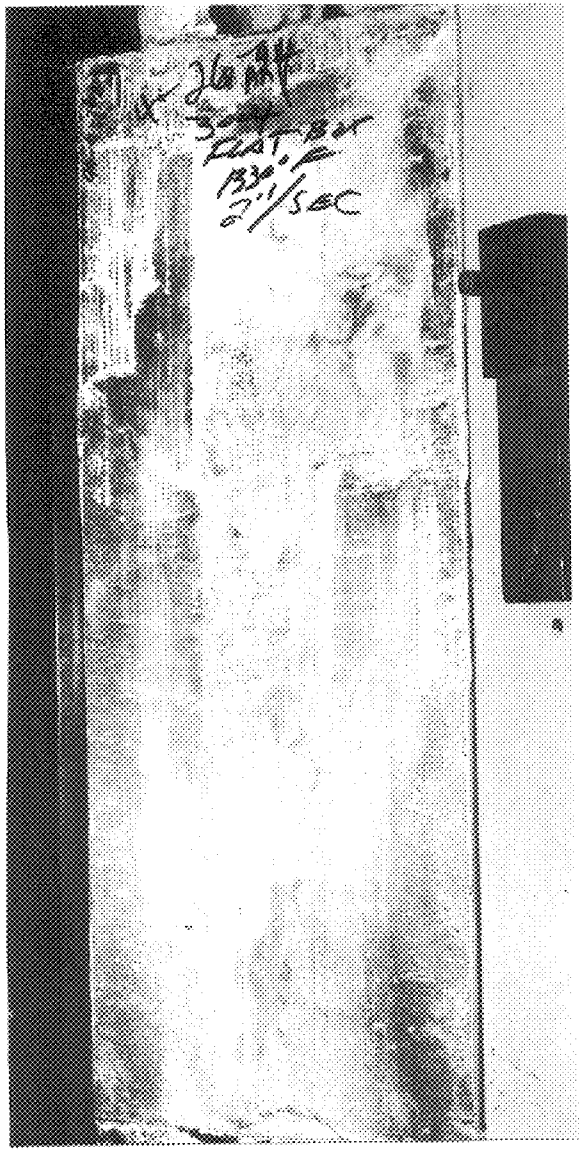

Example 1 is repeated except no layer of GRAFOIL friction reducing material is attached to the underside of the Q-BLOC or to the back portion of the feed box. The resultant slab has relatively poor surface quality which includes rough areas and drag lines created by pieces of the Q-BLOC layer which are dislodged during the casting operation. The poor surface quality of the resultant slab is shown in the photograph of FIG. 13.

EXAMPLE 6

Figure 14:
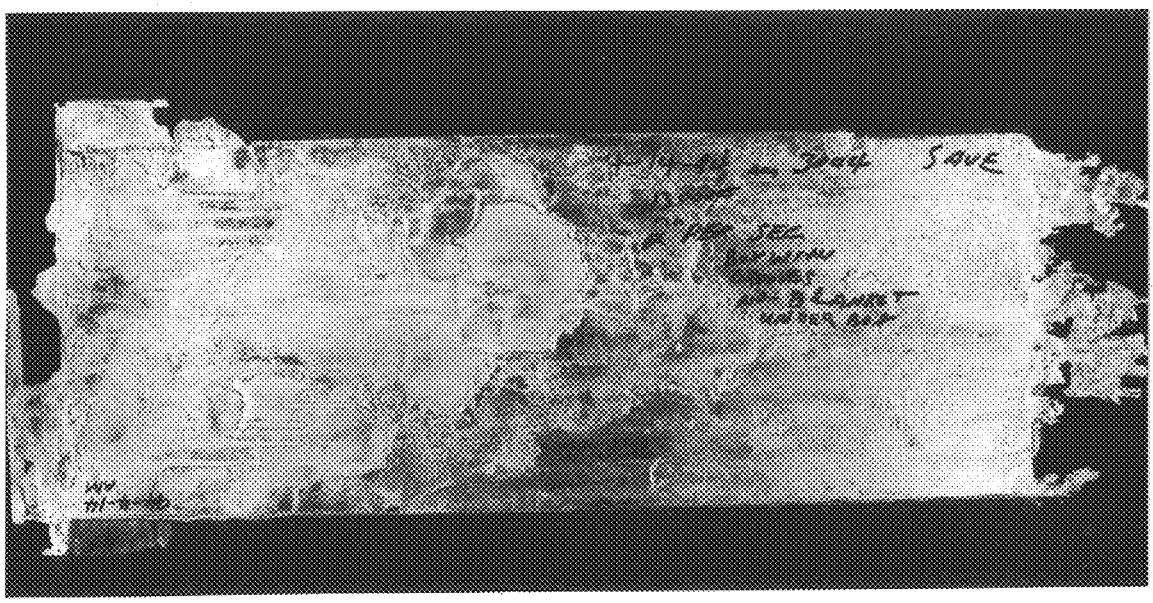

Example 1 is repeated except no layer of Q-BLOC resilient insulating material is used, and the GRAFOIL friction reducing layer is applied directly to the entire underside of the feed box. The resultant casting has poor surface quality due to premature solidification of the molten metal near the nozzle tip. The poor surface quality of the resultant slab is shown in the photograph of FIG. 14.

While particular embodiments of the invention have been described herein, for purposes of illustration, it will be evident to those skilled in the art that numerous variations of the details may be made without departing from the invention as set forth in the appended claims.

What is claimed is:

1. Apparatus for casting a metal product comprising:

(a) a casting mold; and (b) a molten metal delivery nozzle for delivering molten metal to the mold, the nozzle comprising:

(i) at least one interior surface for containing the molten metal;

(ii) at least one substantially planar exterior surface in contact with the casting mold;

(iii) a sloped surface extending from the interior surface toward the exterior surface defining a nozzle tip for reducing molten metal turbulence as the metal exits the nozzle;

(iv) means for substantially sealing the nozzle against the mold and for thermally insulating the nozzle comprising a layer of resilient, thermally insulating material disposed on the nozzle; and (v) a layer of friction reducing material disposed on the layer of resilient, thermally insulating material.

2. The apparatus of claim 1, wherein the molten metal delivery nozzle is slidingly engaged with the casting mold.

3. The apparatus of claim 1, wherein the sloped surface is substantially planar.

4. The apparatus of claim 1, wherein the casting mold comprises at least one moving belt.

5. The apparatus of claim 1, wherein the casting mold comprises means for cooling at least a portion of the mold adjacent an engaging surface between the mold and the nozzle.

6. The apparatus of claim 1, wherein the layer of resilient, thermally insulating material has a thickness of less than about 0.3 inch.

7. The apparatus of claim 1, wherein the layer of resilient, thermally insulating material has a thickness of from about 0.05 to 0.25 inch.

8. The apparatus of claim 1, wherein the resilient, thermally insulating material includes fibrous glass and a latex binder.

9. The apparatus of claim 1, wherein the layer of resilient, thermally insulating material comprises a substantially planar exterior surface which is in contact with the casting mold.

10. The apparatus of claim 1, wherein the layer of friction reducing material comprises graphite foil.

11. The apparatus of claim 10, wherein the graphite foil has a thickness less than about 0.1 inch.

12. The apparatus of claim 10, wherein the graphite foil has a thickness of from about 0.005 to 0.02 inch.

* * * * *